US007111949B2

(12) United States Patent
Parisi et al.

(10) Patent No.: US 7,111,949 B2
(45) Date of Patent: Sep. 26, 2006

(54) PROCESS FOR MANUFACTURING RETROREFLECTIVE PRINTED MATERIAL

(75) Inventors: Agostino Parisi, Scanzorosciate (IT); Cesare Bartoli, Scanzorosciate (IT)

(73) Assignee: Industria Bergamasca Rifrangenti S.r.l., Scanzorosciate (BG) (IT)

( * ) Notice: Subject to any disclaimer, the term of this patent is extended or adjusted under 35 U.S.C. 154(b) by 0 days.

(21) Appl. No.: 10/540,098

(22) PCT Filed: Nov. 19, 2003

(86) PCT No.: PCT/EP03/12948

§ 371 (c)(1),
(2), (4) Date: Jun. 20, 2005

(87) PCT Pub. No.: WO2004/057100

PCT Pub. Date: Jul. 8, 2004

(65) Prior Publication Data

US 2006/0072198 A1 Apr. 6, 2006

(30) Foreign Application Priority Data

Dec. 19, 2002 (EP) ..... 02425785

(51) Int. Cl.
*G02B 5/128* (2006.01)

(52) U.S. Cl. ..... 359/536

(58) Field of Classification Search ..... 359/534, 359/536, 539, 540, 542; 427/913.3; 264/1.9, 264/1.7

See application file for complete search history.

(56) References Cited

U.S. PATENT DOCUMENTS

| | | | | |
|---|---|---|---|---|
| 2,231,139 A | | 2/1941 | Reininger | 40/135 |
| 2,422,256 A | | 6/1947 | Phillippi | 40/135 |
| 3,689,346 A | | 9/1972 | Rowland | 156/245 |
| 3,700,305 A | | 10/1972 | Bingham | 350/105 |
| 4,075,049 A | | 2/1978 | Wood | 156/220 |
| 4,082,426 A | | 4/1978 | Brown | 350/105 |
| 4,102,562 A | * | 7/1978 | Harper et al. | 359/518 |
| 4,605,461 A | | 8/1986 | Ogi | 156/233 |
| 4,656,072 A | | 4/1987 | Coburn, Jr. et al. | 428/40 |
| 4,763,985 A | | 8/1988 | Bingham | 350/105 |
| 4,952,023 A | | 8/1990 | Bradshaw et al. | 350/102 |
| 5,283,101 A | | 2/1994 | Li | 428/141 |
| 5,508,105 A | | 4/1996 | Orensteen et al. | 428/323 |
| 5,620,613 A | | 4/1997 | Olsen | 216/24 |

(Continued)

FOREIGN PATENT DOCUMENTS

| | | |
|---|---|---|
| WO | WO 92/07990 | 5/1992 |

(Continued)

*Primary Examiner*—Euncha P. Cherry
(74) *Attorney, Agent, or Firm*—David A. Farah; Sheldon & Mak PC

(57) ABSTRACT

A process for manufacturing retroreflective printed material, the process comprising a) providing a composite comprising a temporary support sheet with a layer of microspheres partially embedded in the temporary support sheet such that the surfaces of the microspheres are partially exposed; b) applying a reflecting layer on the microspheres; c) applying a priming layer either on the partially exposed surfaces of the microspheres or on the reflecting layer; d) transferring a printed design layer from a transfer medium with the printed design on the primer layer and separating the transfer medium without the printed design from the printed design layer; e) applying a binder layer on the printed design layer; f) applying a base fabric on the binder layer and separating the temporary support sheet from the layer of microspheres, thereby creating the retroreflective printed material. A retroreflective printed material made according to the process.

30 Claims, 4 Drawing Sheets

U.S. PATENT DOCUMENTS

| | | | | |
|---|---|---|---|---|
| 5,620,630 | A | 4/1997 | Onishi et al. | 252/299.01 |
| 5,643,400 | A | 7/1997 | Bernard et al. | 156/500 |
| 5,679,198 | A | 10/1997 | Olsen et al. | 156/230 |
| 5,738,746 | A | 4/1998 | Billingsley et al. | 156/239 |
| 5,785,790 | A | 7/1998 | Olsen et al. | 156/239 |
| 5,962,121 | A | 10/1999 | Mori | 428/323 |
| 6,120,636 | A | 9/2000 | Nilsen et al. | 156/230 |
| 6,416,188 | B1 | 7/2002 | Shusta et al. | 359/536 |

FOREIGN PATENT DOCUMENTS

| | | |
|---|---|---|
| WO | WO 94/25666 | 11/1994 |
| WO | WO 96/24867 | 8/1996 |

* cited by examiner

PROCESS FOR MANUFACTURING RETROREFLECTIVE PRINTED MATERIAL

CROSS-REFERENCE TO RELATED APPLICATIONS

This application is a national phase filing of International Patent Application No. PCT/EP2003/012948 entitled "Process for Manufacturing Retroreflective Printed Material," filed Nov. 19, 2003, which claims priority from European Patent Application No. 02425785.9 filed Dec. 19, 2002; the contents of which are incorporated by reference herein in their entirety.

FIELD

The present invention is related to a process for manufacturing retroreflective printed material.

BACKGROUND

The use of safety garments comprising retroreflective printing reduces the risk of accidents, especially for persons in certain professions such as for example firefighters and paramedics, as well as for athletes. Commercial products suitable for use with reflective garments generally consist of a single color. For example, U.S. Pat. No. 4,763,985 to Bingham, U.S. Pat. No. 5,283,101 to Li and U.S. Pat. No. 5,738,746 to Billingsley et al., disclose launderable retroreflective grey-colored products.

A number of patents disclose processes for producing colored effects and printed effects, as well as reflectivity. For example, U.S. Pat. No. 5,962,121 to Mori discloses a retroreflective structure capable of exhibiting a decorative rainbow-colored effect during both daytime and nighttime. U.S. Pat. No. 4,605,461 to Ogi discloses a process for transferring a retroreflective pattern onto a fabric. U.S. Pat. No. 4,102,562 to Harper et al. discloses retroreflective images formed on garments and other substrates. U.S. Pat. No. 5,508,105 to Orensteen et al. discloses a thermal printing system and a colorant/binder for printing frangible, retroreflective sheeting material. U.S. Pat. No. 5,620,613 to Olsen discloses the printing of designs or emblems on garments, where the design comprises a monolayer of microspheres, and a first printing of a first color layer with a silk-screening system. When the prints of the first color are dried, subsequent colors can be printed through the same technique until the design on the layer of microspheres is completed. A similar patent for decorating textile surfaces, U.S. Pat. No. 5,679,198 to Olsen et al., discloses a multi-step printing of many colors prepared with a polyester resin and an isocyanate hardener, dried before printing the following color. Also in U.S. Pat. No. 5,785,790 to Olsen et al., the same silk-screening multi-color printing technique is used with a system of colors made of polyester resin hardened with isocyanate. Many other United States patents disclose processes for producing retroreflective materials, including U.S. Pat. No. 2,231,139 to Reininger, U.S. Pat. No. 2,422,256 to Phillippi, U.S. Pat. No. 3,689,346 to Rowland, U.S. Pat. No. 4,082,426 to Brown, U.S. Pat. No. 4,656,072 to Coburn, Jr. et al., U.S. Pat. No. 4,952,023 to Bradshaw et al. and U.S. Pat. No. 5,643,400 to Bernard et al. U.S. Pat. No. 6,120,636 to Nilsen et al. discloses a high speed, low cost process for producing sheets patterned with drawings and emblems using a rotary screen printing system with cylinders, and hardening with UV lamps.

There does not appear, however, to be a practical process for producing a printed retroreflective product for fashion garments using designs containing one or more than one color. While, processes using silk-screen printing with one water-based color or solvent-based colors have been proposed, these processes are unfeasible for reproducing fashion designs with many colors upon a retroreflective material.

Additionally, many patents disclose the use of screen-printing technology, such as for example U.S. Pat. No. 5,620,630 to Onishi et al. and U.S. Pat. No. 5,785,790 to Olsen et al., among others. With this screen-printing technology, however, it is impossible to print designs on garments comprising many colors while maintaining design and color accuracy on a layer of microspheres to produce retroreflecting materials. The same is true of a rotary screen-printing system disclosed in U.S. Pat. No. 6,120,636 to Nilsen et al. Therefore, there remains a need for a process for printing retroreflecting products comprising one or more than one color, with a high production speed, production flexibility and without producing significant amounts of pollution.

SUMMARY

According to one embodiment of the present invention, there is provided a process for manufacturing retroreflective printed material, the process comprising a) providing a composite comprising a temporary support sheet with a layer of microspheres partially embedded in the temporary support sheet such that the surfaces of the microspheres are partially exposed; b) applying a reflecting layer on the microspheres; c) applying a priming layer either on the partially exposed surfaces of the microspheres or on the reflecting layer; d) transferring a printed design layer from a transfer medium with the printed design on the primer layer and separating the transfer medium without the printed design from the printed design layer; e) applying a binder layer on the printed design layer; f) applying a base fabric on the binder layer and separating the temporary support sheet from the layer of microspheres, thereby creating the retroreflective printed material, where the reflecting layer is either applied on the microsphere surface of the composite between the priming layer and the microsphere surface of the composite, or is applied on the printed design layer between the printed design layer and the binder layer. In one embodiment, the microspheres are transparent glass microspheres. In another embodiment, the microspheres have a diameter, and the microspheres are partially embedded in the temporary support sheet to a depth ranging between 40% and 50% of the microsphere diameter.

In another embodiment, the temporary support sheet comprises a coating film and a backing sheet. In a preferred embodiment, the coating film is selected from the group consisting of a polymeric coating film, polyethylene, polypropylene, a low-density polyethylene thermo-adhesive film and an acrylic auto-adhesive film. In a preferred embodiment, the backing sheet is selected from the group consisting of kraft paper and polyester film. In a preferred embodiment, providing a composite comprises placing the microspheres on the temporary support sheet by a process selected from the group consisting of printing, cascading, transferring and screening.

In another embodiment, the reflecting layer is a dielectric mirror layer applied on the microsphere surface of the composite, and where the priming layer is applied on the dielectric mirror layer. In another embodiment, the reflecting layer is a light reflecting material layer applied on the printed design layer, and where the binder layer is applied on the light reflecting material layer. In a preferred embodiment, the light reflecting material layer is a vapor coating of a metal or thin reflective aluminium film layer applied by vacuum deposition.

In one embodiment, the priming layer is selected from the group consisting of a thin layer of transparent thermo-adhesive bicomponent polyurethane resin and a resin of a water polyether polyurethane dispersion. In another embodiment, the printed design layer from a transfer medium with the printed design comprises a plurality of colors. In another embodiment, the transfer medium with the printed design comprises a design with sublimate pigments. In a preferred embodiment, transferring a printed design comprises thermo-transferring at a temperature between 180° C. and 220° C.

In another embodiment, the transfer medium with the printed design comprises a design printed on a polymer film. In a preferred embodiment, transferring a printed design comprises thermo-transferring at a temperature between 100° C. and 120° C.

In one embodiment, the binder layer is selected from the group consisting of a bicomponent polyurethane resin and a thin layer of a hot-melt adhesive.

According to another embodiment of the present invention, there is provided a retroreflective printed material made according to the process of the present invention. In one embodiment, there is provided an article of clothing, sportswear or footwear comprising the retroreflective printed material of the present invention.

According to another embodiment of the present invention, there is provided a retroreflective printed material comprising: a) a microspheres layer; b) a priming layer on the microsphere layer; c) a printed design layer on the primer layer; d) a binder layer on the printed design layer; e) a base fabric on the binder layer; and f) a reflecting layer; where the reflecting layer is either between the microsphere layer and the priming layer, or is between the printed design layer and the binder layer. In one embodiment, the microspheres are transparent glass microspheres. In another embodiment, the reflecting layer is a dielectric mirror layer. In one embodiment, the reflecting layer is a vapor coating of a metal or thin reflective aluminium film layer. In another embodiment, the priming layer is selected from the group consisting of a thin layer of transparent thermo-adhesive bicomponent polyurethane resin and a resin of a water polyether polyurethane dispersion. In one embodiment, the printed design layer comprises a plurality of colors. In another embodiment, the binder layer is selected from the group consisting of a bicomponent polyurethane resin and a thin layer of a hot-melt adhesive.

FIGURES

These and other features, aspects and advantages of the present invention will become better understood with regard to the following description, appended claims, and accompanying figures which depict some of the steps in certain embodiments of the process of the present invention, where:

Figure 5:
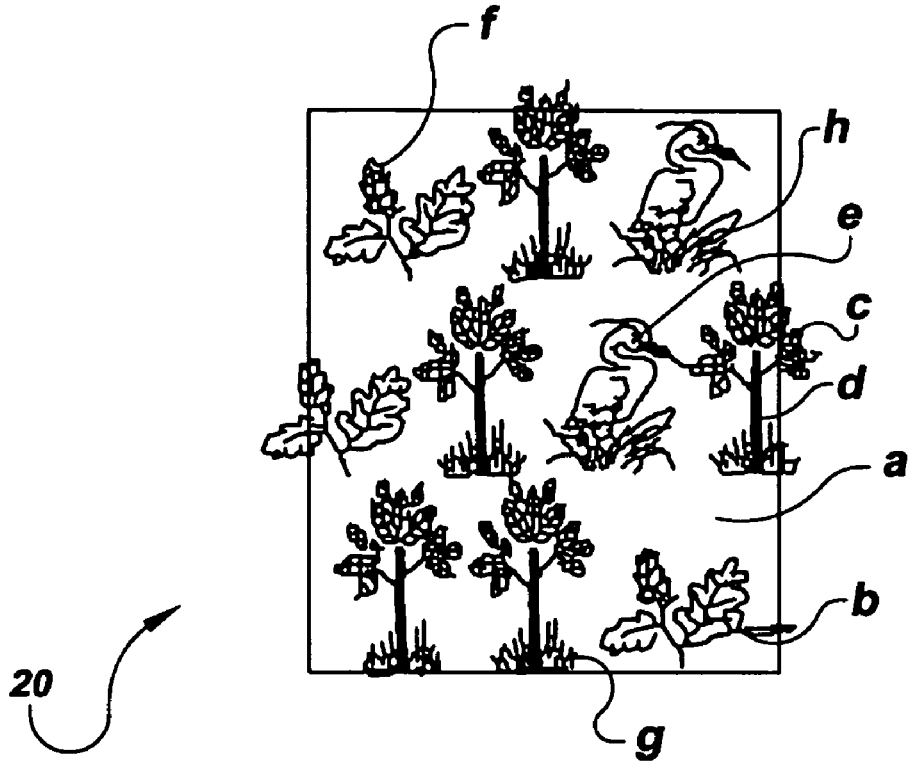
Figure 6:
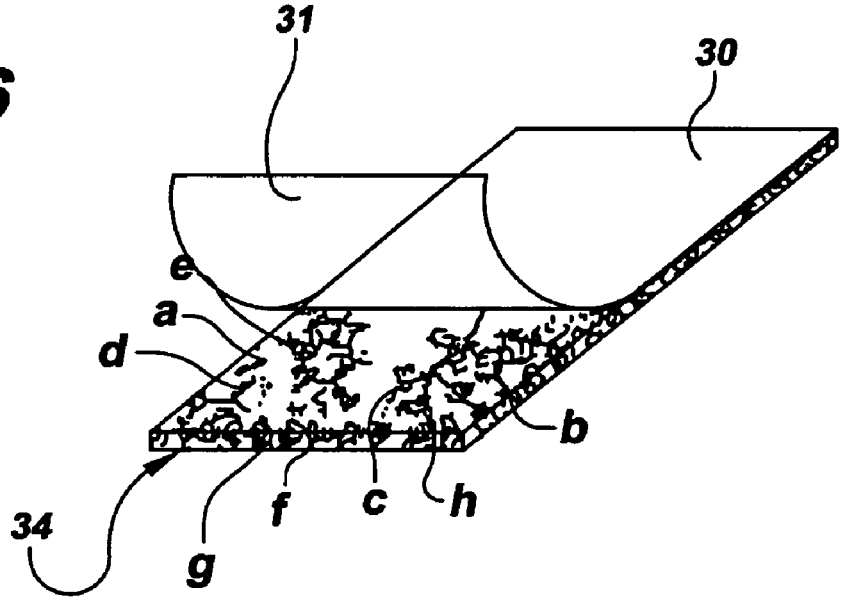

FIG. 5 is a schematic plan view of a transfer medium with a printed design suitable for use with the present method; and FIG. 6 is a schematic drawing showing the design on a transfer medium with the printed design, as shown in FIG. 5, being transferred to a surface comprising a layer of microspheres as the printed transferred image, while the transfer medium without the printed design is partially released from the printed transferred image, according to the present invention.

DESCRIPTION

According to one embodiment of the present invention, there is provided a process for manufacturing retroreflective printed material. The process can be performed at a rapid production rate, is flexible and does not produce significant amounts of pollution. The machinery used with the present process requires a relatively low investment of capital and a relatively small amount of floor space compared with other printing processes, and requires no auxiliary equipment. Moreover, commercial transfer media suitable for use with the present process are widely available. The present invention can be used to produce retroreflective printing on a substrate, such as for example fabric for garments. The present process is especially suited for printing complex designs in multiple colors on retroreflecting garments for the fashion industry, such as for example, clothing, sportswear, footwear and fashion accessories, as well as for producing retroreflective printing on products used in high risk professions where high visibility increases safety. The present process involves transferring a printed design comprising one or more than one color on a paper or plastic base onto the surface of a temporary support sheet having a layer of partially embedded microspheres and coated with a priming layer.

Though certain steps of the process are disclosed and shown in the Figures, the steps are not intended to be limiting nor are they intended to indicate that each step depicted is essential to the process, but instead are exemplary steps only. Further, though the present invention is disclosed in part with reference to certain examples, which show some of the features and advantages of the invention, the ingredients and the specific amounts of the ingredients disclosed, as well as other conditions and details are not intended to be limiting to the scope of the present invention. Other ingredients, amounts and conditions can be used, as will be understood by those with skill in the art with reference to this disclosure. Certain embodiments of the process will now be disclosed in detail.

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by its intended use.

Unless otherwise specified, all amounts expressed in the examples are in parts by weight.

According to one embodiment of the present invention, there is provided a process for manufacturing retroreflective printed material. In one embodiment, the present process comprises, first, providing a composite of a temporary support sheet comprising a layer of microspheres partially embedded in the temporary support sheet such that the surface of the microspheres are partially exposed. In a preferred embodiment, the microspheres are transparent glass microspheres. In another preferred embodiment, the temporary support sheet comprises a layer of softened polymer, and the microspheres partially embedded in the softened polymer to a depth ranging between 20% and 50% of the microsphere diameter, as conventionally used in retroreflective materials, and as disclosed in U.S. Pat. No. 3,700,305 to Bingham and U.S. Pat. No. 6,416,188 B1 to Shusta et al. among other sources. Next, a design from a commercial transfer medium is thermo-transferred onto the microsphere surface of the composite.

Two kinds of commercial transfer media with a printed design can be used with the present method: 1) designs with sublimate pigments printed on a paper base; and 2) designs printed on a polymer film supported by a release paper base or a polymer film base, such as for example polypropylene film. When thermo-transferring a design with sublimate pigments, the transfer temperature ranges between 180° C. and 220° C. A transfer temperature close to 220° C. causes a maximum yield of color transfer, but a partial transfer of colors at lower temperatures can also give a satisfactory aesthetic design on the final retroreflective printed product.

When thermo-transferring a design printed on polymer film, the present process comprises applying a priming layer on the microsphere surface of the composite. In one embodiment, the priming layer is as a thin layer of transparent thermo-adhesive bicomponent polyurethane resin having a thickness of about 1 micron. The priming layer is partially cured by drying, and operates as thermo-adhesive between microspheres and the design printed on the polymer film. In this embodiment, the transfer temperature is lower than 150° C. In a preferred embodiment, the transfer temperature is between 100° C. and 120° C.

The present process further comprises applying a reflecting layer applied on the partially exposed surfaces of the microspheres. In one embodiment, the reflecting layer comprises a substantially transparent dielectric mirror layer. In another embodiment, the reflecting layer comprises a light reflecting material layer applied on the printed design layer over the microsphere surface of the composite. In a preferred embodiment, the light reflecting material layer is a thin reflective aluminium film layer by vacuum deposition after the printing process. When the reflective aluminium film layer is applied, the dielectric mirror layer is not necessary as the product produced has a sufficient reflective intensity for a printed fashion product without a dielectric mirror layer.

In another embodiment, the process further comprises applying a binder layer on the printed design layer, or on the light reflecting material layer if present. The binder layer is partially dried and a base fabric is applied to the binder layer. In one embodiment, the binder layer is a bicomponent polyurethane resin. In another embodiment, the binder layer is a thin layer of a hot-melt adhesive.

Figure 4:
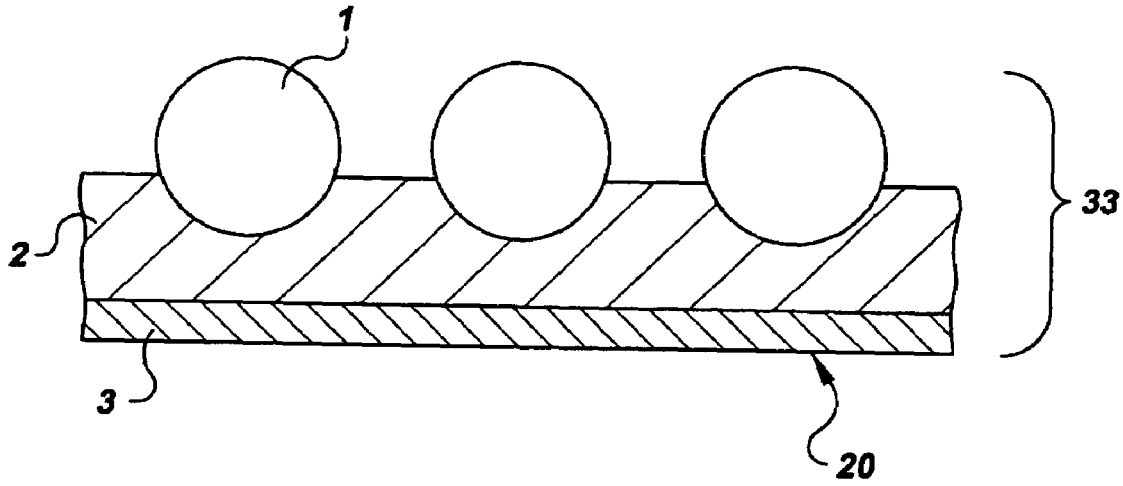
FIG. 4 is a partial cross-sectional view of a composite of a temporary support sheet with partially embedded microspheres according to the present invention.

Referring now to FIG. 4, there is shown a partial cross-sectional view of a composite of a temporary support sheet with partially embedded microspheres according to the present invention. As can be seen, the temporary support sheet 20 comprises a coating film 2 and a backing sheet 3. The coating film 2 is a softenable material, such as for example a polymer. In one embodiment, the coating film 2 is a polymeric coating film. In another embodiment, the coating film 2 is a polymer selected from the group consisting of polyethylene and polypropylene. In a preferred embodiment, the coating film is a low-density polyethylene thermo-adhesive film. In another embodiment, the polymeric coating film is an acrylic auto-adhesive film. The backing sheet 3 comprises a stiff material. In one embodiment, the backing sheet is selected from the group consisting of kraft paper and polyester film. The temporary support sheet 20 can be produced by known processes, such as disclosed in U.S. Pat. No. 4,102,562 to Harper et al.

The microspheres 1 used in the present invention will typically have an average diameter in the range of about 30 to 200 microns and a refractive index of between about 1.7 to 2.0. Preferably, the microspheres 1 are arranged substantially in a monolayer on the temporary support sheet 20. The microspheres 1 can be placed on the temporary support sheet 20 by printing, cascading, transferring, screening or any other suitable process, as will be understood by those with skill in the art with reference to this disclosure. After placement, the microspheres 1 are embedded in the temporary support sheet 20 to a depth of between about 20% to 50% of their average diameter, such as for example using a pressure roller or by heating the softened polymer, yielding a composite of the temporary support sheet and microspheres 33.

Figure 1:
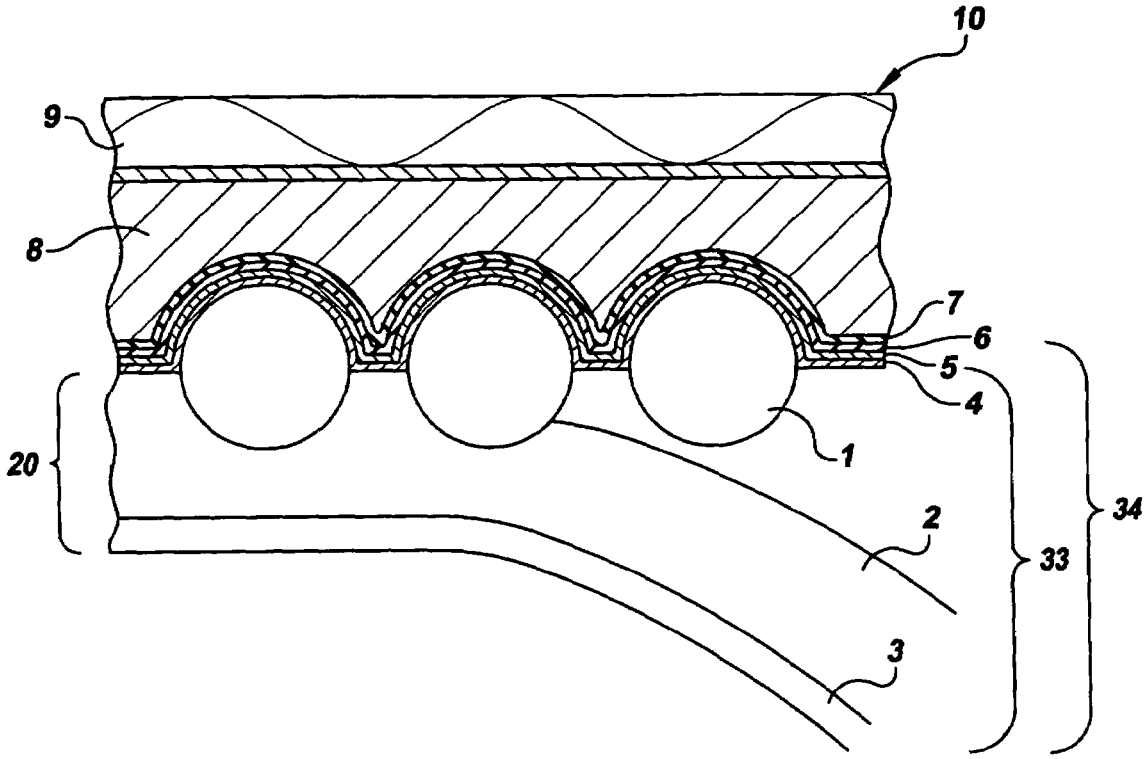
FIG. 1 is a partial cross- sectional view of a portion of an article of clothing that is partially delaminated from the temporary support sheet, according to the present invention.

Referring now to FIG. 1, there is shown a partial cross-sectional view of a retroreflective printed material 10 being produced according to the present invention, as it is partially separated from the temporary support sheet 20 part of the composite of a temporary support sheet and microspheres 33. As can be seen, in one embodiment, a dielectric mirror layer 4 is disposed adjacent to the surface of the microspheres 1. Further, a priming layer 5 covers the microsphere surface of the composite 33, or, as shown, the dielectric mirror layer 4 when present. A printed design layer 6 is disposed on the priming layer, and preferably has a thickness of less than 0.1 micron in the case of designs with sublimate pigments printed on a paper base, and less than 0.5 microns in the case of designs having a polymer film supported by a release paper base or a polymer film base. In one embodiment, the printed design layer 6 is covered with a light reflecting material layer 7, such as for example a vapor coating of a metal, a vacuum-nebulized reflective aluminium film layer, or other suitable light reflecting material, as will be understood by those with skill in the art with reference to this disclosure. When the light reflecting material layer 7 is present, the dielectric mirror layer 4 is not necessary. Finally, a binder layer 8 covers the printed design layer 6, or the light reflecting material layer 7 when present, and binds a base fabric 9, such as for example a polyester/cotton fabric, a nylon knitted fabric made of a Lycra® (E. I. du Pont De Nemours and Company, Wilmington, Del. US) or other textile base fabrics.

Figure 2:
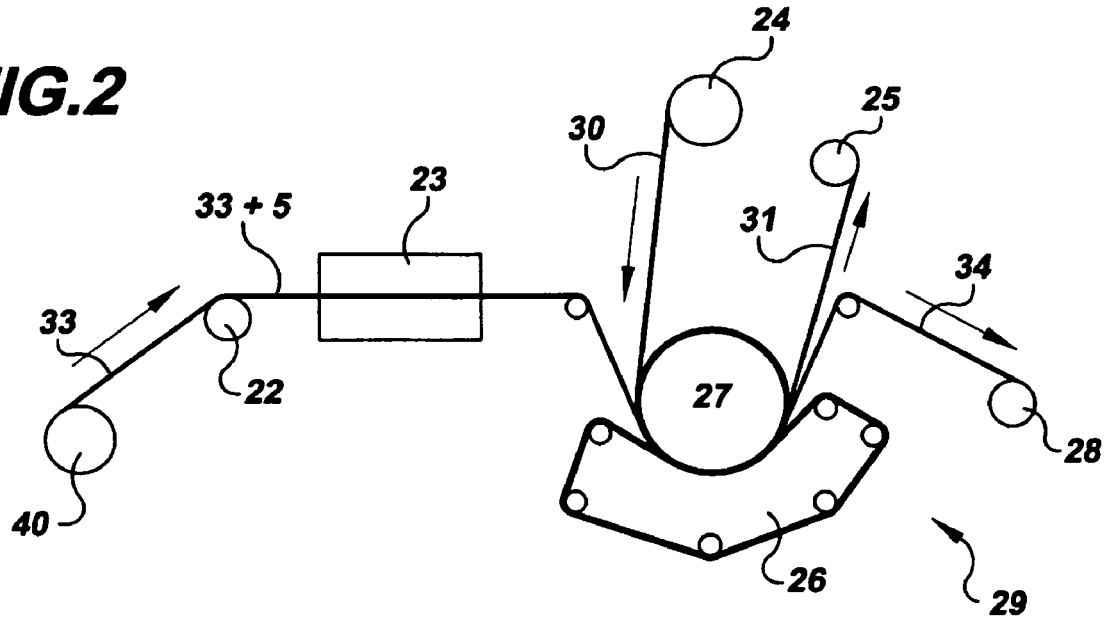
FIG. 2 is a schematic drawing of a machine that can be used in the process of the present invention.
Figure 3:
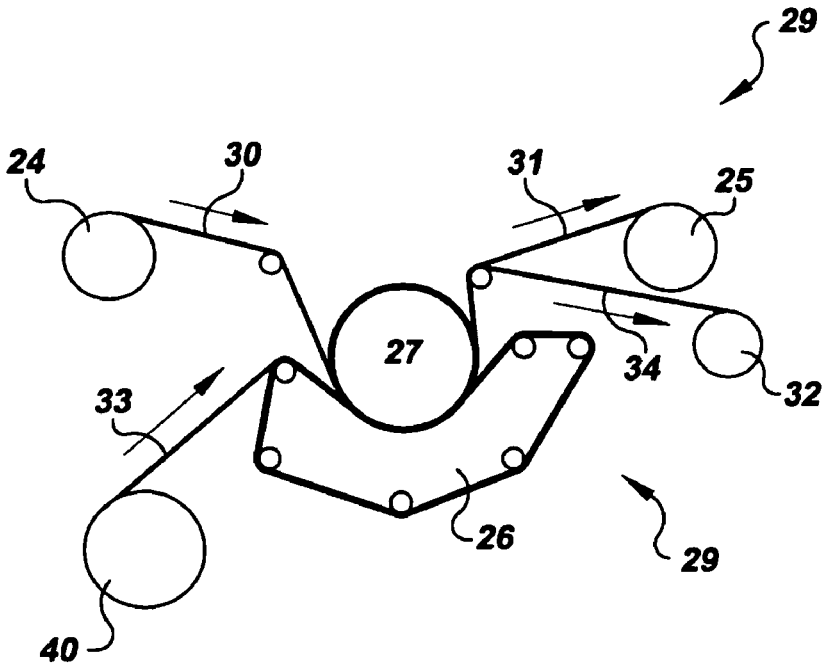
FIG. 3 is a schematic drawing of a machine for transferring printed designs with sublimate pigments according to the present invention.

Referring now to FIG. 2 and FIG. 3, there are shown schematic drawings of machines that can be used in the process of the present invention. As can be seen, the machines comprise a rotary machine 29 for transfer printing using a heated calender, such as for example, a rotary machine manufactured by Lemaire & Cie, Roubaix, France or Monti Officine Fonderie S.p.A., Thiene, Italy.

FIG. 3 is a schematic drawing of a machine for transferring printed designs with sublimate pigments according to the present invention. As can be seen, the composite layer 33 supplied by cylinder 40, and the transfer medium with the printed design 30 supplied by a cylinder 24 are pressed together between a heated cylinder 27 and a felt 26 in a continuous process. At the end of the process, the machine dispenses the transfer medium without the printed design 31 wound on a cylinder 25, and the printed transferred image 34 wound on another cylinder 32.

FIG. 2, is a schematic drawing of a continuous machine for doctor-knife coating the microsphere surface of a composite of a temporary support sheet and microspheres 33. As can be seen, the continuous printing process coats the composite of a temporary support sheet and microspheres 33 supplied by a cylinder 40 with a priming layer 5 supplied by a cylinder 22 in a coating machine 23. At the end of the process, the machine dispenses the printed transferred image 34 wound on a cylinder 28.

Referring now to FIG. 5, there is shown a schematic plan view of a transfer medium with a printed design 30 suitable for use with the present method. In this example, the design comprises images derived from natural subjects, and comprises 8 colors labeled a, b, c, d, e, f, g and h. Transfer media with printed designs of this type are widely available commercially, and are widely used in many applications in the textile industries, as well as in other fields, such as for example, in the fields of household accessories, furniture, interior decorations, and motor vehicles. Samples of retroreflective printed material were prepared according to the present invention using transfer media from Transfertex GmbH & Co., Kleinostheim, Germany and a polypropylene printed film (Decotrans™) from Miroglio S.p.A.—Sublitex, Alba, Italy.

Referring now to FIG. 6, there is shown a schematic drawing showing the design on a transfer medium with the printed design 30, as shown in FIG. 5, being transferred to a surface comprising a layer of microspheres as the printed transferred image 34, while the transfer medium without the printed design 31 is partially released from the printed transferred image 34, according to the present invention.

EXAMPLE 1

A monolayer of glass microspheres having diameters between 40 and 100 microns was produced by cascading the microspheres onto a kraft paper covered with an acrylic auto-adhesive film. The layer of microspheres was then transferred onto a temporary support sheet comprising a backing sheet of polyester covered with a coating film of low-density polyethylene thermo-adhesive film 50 microns thick. The transfer was made using a heated calender as shown in FIG. 3, at a cylinder temperature of 140° C. The contact time was 5 seconds and the pressure between the heated cylinder and the felt was 5 bars, which yielded a penetration of the microspheres into the temporary support sheet of about 40% of their diameter, thereby creating a composite of a temporary support sheet and microspheres.

A dielectric mirror layer, as described in U.S. Pat. No. 3,700,305 to Bingham, was then applied to the exposed surface of the microspheres on the composite. The amount of the dielectric mirror layer was about 4 g/m$^2$.

A bicomponent polyurethane resin priming layer was next applied over the dielectric mirror layer, by coating the dielectric mirror layer with the solution according to formulation 1 with a doctor-knife coating machine or a graved-roll coating machine.

Formulation 1

| Ingredients | Parts by Weight |
|---|---|
| Polyurethane resin ("B 10" from COIM S.p.A. Milan, Italy) | 100 |
| Curing agent ("Imprafix TH" from Bayer | 5 |

-continued

Formulation 1

| Ingredients | Parts by Weight |
|---|---|
| Material Science AG, Leverkusen, Germany) | |
| Methylethylketone | 150 |

The priming layer was dried and partially cured at 110° C.

At the end of the oven as disclosed with respect to FIG. 2, the product was fed into the calender, heated to 130° C., and laminated with a transfer medium with the printed design comprising a polypropylene printed film (Decotrans™) having the design shown in FIG. 5. The contact time was about 10 seconds. Then, the polypropylene portion of the transfer medium without the printed design and the printed transferred image were separated. Next, a binder layer comprising a solution of polyurethane resin according to formulation 2, was applied to the printed transferred image at a thickness of approximately 125 microns when wet.

Formulation 2

| Ingredients | Parts by Weight |
|---|---|
| Polyurethane resin ("B 10" from COIM S.p.A. Milan, Italy) | 100 |
| Curing agent ("Desmodur REQUEST FOR EXAMINATION" from Bayer Material Science AG, Leverkusen, Germany) | 5 |
| Methylethylketone | 40 |
| Melamine curing agent ("C6" from COIM S.p.A. Milan, Italy) | 3 |

The polyurethane resin binder layer was partially dried at 80° C. At the end of the oven, the surface of the still tacky binder layer resin was superimposed and calendered onto a base fabric containing 65% polyester and 35% cotton. After calendering the laminated fabric at 100° C. and a pressure of 5 bars, the fabric was cooled and the temporary support sheet was peeled off, yielding a fabric with the retroreflective printed design. This printed transferred image was cured at 150° C. in an oven for about 2 minutes to finish curing the polyurethane resin binder layer, and yielding the retroreflective printed material.

EXAMPLE 2

A monolayer of glass microspheres having similar characteristics as those disclosed in Example 1 was deposited on a temporary support sheet comprising a coating film of low-density polyethylene film of 50 micron thickness supported by a backing sheet of 40 micron polyester film. The composite of the temporary support sheet and microspheres was then heated for between 2 and 4 minutes at between 150° C. and 160° C., which yielded a penetration of the microspheres into the polyethylene film of about 40% of their diameter, with little or no space between microspheres. The exposed surface of the microspheres was then coated with a dielectric mirror layer, and the subsequent steps of the process were the equivalent to those disclosed in Example 1.

EXAMPLE 3

A monolayer of glass microspheres having diameters between 40 and 100 microns was produced by cascading the microspheres onto a thick release paper covered with an acrylic auto-adhesive film as described in Example 2 of U.S. Pat. No. 4,075,049 to Wood. A priming layer comprising a resin of a water polyether polyurethane dispersion according to formulation 3 was doctor-knife coated on the composite of the temporary support sheet and microspheres.

Formulation 3

| Ingredients | Parts by Weight |
|---|---|
| Polyurethane water based resin ("Idrocap 930" from Icap-sira Chemicals and Polymers S.p.A., Milan, Italy) | 100 |
| Curing agent ("Icaplink X3" Icap-sira Chemicals and Polymers S.p.A., Milan, Italy) | 5 |
| water | 40 |
| thickening agent ("Idrocap 200" from Icap-sira Chemicals and Polymers S.p.A) | a.r. |

The amount of wet priming layer resin was about 10 g/m$^2$ and was adjusted with the doctor-knife profile, resin dilution and viscosity. The amount of dried film was about 3 g/m$^2$. The priming layer resin was partially cured at 110° C. At the end of the oven as disclosed with respect to FIG. 2, the product was fed into the calender, heated to 130° C., and laminated with a transfer medium with the printed design comprising a polypropylene printed film (Decotrans™) having the design shown in FIG. 5. The contact time was about 10 seconds. Then, the polypropylene portion of the transfer medium without the printed design and the printed transferred image were separated. The resulting printed transferred image was further processed according to whether it comprised a light reflecting material layer, in this case a vapor coating of a metal such as an aluminium light reflecting material. When the printed transferred image comprised the light reflecting material layer, the subsequent steps of the process were the same as disclosed in Example 1. When the composite did not comprise a light reflecting material layer, the subsequent steps of the process comprised applying a polyurethane binder layer by knife coating, and then applying a textile to the binder layer.

The aesthetic printing effect without the light reflecting material layer was very regular but the average initial reflectivity was between 8 and 15 cd/(luxm). This average initial reflectivity was low for use in connection with retroreflecting garments for high risk professions, but was suitable for use in connection with retroreflecting fashion fabric. The light reflecting material layer of the product with the light reflecting material layer favorably affected the design colors and the reflectivity was greater than 50 cd/(luxm), making the product suitable for use in connection with high risk professions.

EXAMPLE 4

A monolayer of glass microspheres having diameters between 40 and 100 microns was produced by cascading the microspheres onto a thick release paper covered with an acrylic auto-adhesive film as described in Example 2 of U.S. Pat. No. 4,075,049 to Wood. A dielectric mirror layer was then applied to the exposed microsphere surface of the composite of a temporary support sheet and microspheres. Next, a transfer print process was made using a commercial transfer medium with a printed design with sublimate pigments from Transfertex GmbH & Co. The transfer temperature was about 185° C., however, the heated roll was in contact with the back of the transfer medium, and therefore, the real temperature of the microsphere layer of the composite was higher than the real temperature of the transfer medium, but sufficient for obtaining a good yield of pigment sublimation onto the exposed surface of the microspheres. Next, a metallized light reflecting material layer was applied to the printed transferred image using formulation 2 with a doctor-knife coating machine. Next, a polyurethane resin binder layer was applied and was partially dried at 80° C. At the end of the oven, the surface of the still tacky binder layer resin was superimposed and calendered onto a base fabric containing 65% polyester and 35% cotton. After calendering the laminated base fabric at 100° C. and a pressure of 5 bars, the fabric was cooled and the temporary support sheet was peeled off. Then, retroreflective printed fabric was cured at 150° C. in an oven for about 2 minutes to finish curing the binder layer.

Although the present invention has been discussed in considerable detail with reference to certain preferred embodiments, other embodiments are possible. Therefore, the scope of the appended claims should not be limited to the description of preferred embodiments contained in this disclosure. All references cited herein are incorporated by reference in their entirety.

The invention claimed is:

1. A process for manufacturing retroreflective printed material comprising a viewable surface, the process comprising:

a) providing a composite comprising a temporary support sheet with a layer of microspheres partially embedded in the temporary support sheet such that the surfaces of the microspheres are partially exposed;

b) applying a reflecting layer on the layer of microspheres such that the entire layer of microspheres is covered with the reflecting layer;

c) applying a priming layer either on the partially exposed surfaces of the microspheres or on the reflecting layer such that the entire layer of microspheres or the entire reflecting layer is covered with the priming layer;

d) transferring a printed design layer from a transfer medium on the priming layer and separating the transfer medium from the printed design layer;

e) applying a binder layer on the printed design layer such that the entire printed design layer is covered with the binder layer; and f) applying a base fabric on the binder layer and completely separating the temporary support sheet from the layer of microspheres, thereby creating the retroreflective printed material;

where the printed design layer completely covers the priming layer; and where the reflecting layer is either applied on the microsphere surface of the composite between the priming layer and the microsphere surface of the composite, or is applied on the printed design layer between the printed design layer and the binder layer.

2. The process of claim 1, where the microspheres are transparent glass microspheres.

3. The process of claim 1, where the microspheres have a diameter, and where the microspheres are partially embedded in the temporary support sheet to a depth ranging between 20% and 50% of the microsphere diameter.

4. The process of claim 1, where the temporary support sheet comprises a coating film and a backing sheet.

5. The process of claim 4, where the coating film is selected from the group consisting of a polymeric coating film, polyethylene, polypropylene, a low-density polyethylene thermo-adhesive film and an acrylic auto-adhesive film.

6. The process of claim 4, where the backing sheet is selected from the group consisting of kraft paper and polyester film.

7. The process of claim 1, where providing a composite comprises placing the microspheres on the temporary support sheet by a process selected from the group consisting of printing, cascading, transferring and screening.

8. The process of claim 1, where the reflecting layer is a dielectric mirror layer applied on the microsphere surface of the composite, and where the priming layer is applied on the dielectric mirror layer.

9. The process of claim 1, where the reflecting layer is a light reflecting material layer applied on the printed design layer, and where the binder layer is applied on the light reflecting material layer.

10. The process of claim 9, where the light reflecting material layer is a vapor coating of a metal or thin reflective aluminium film layer applied by vacuum deposition.

11. The process of claim 1, where the priming layer is selected from the group consisting of a thin layer of transparent thermo-adhesive bicomponent polyurethane resin and a resin of a water polyether polyurethane dispersion.

12. The process of claim 1, where the printed design layer from a transfer medium with the printed design comprises a plurality of colors.

13. The process of claim 1, where the transfer medium with the printed design comprises a design with sublimate pigments.

14. The process of claim 13, where transferring a printed design comprises thermo-transferring at a temperature between 180° C. and 220° C.

15. The process of claim 1, where the transfer medium with the printed design comprises a design printed on a polymer film.

16. The process of claim 15, where transferring a printed design comprises thermo-transferring at a temperature between 100° C. and 120° C.

17. The process of claim 1, where the binder layer is selected from the group consisting of a bicomponent polyurethane resin and a thin layer of a hot-melt adhesive.

18. A retroreflective printed material made according to claim 1.

19. An article of clothing, sportswear or footwear comprising the retroreflective printed material of claim 18.

20. The process of claim 1, where the printed design layer has a thickness of less than 0.1 micron.

21. The process of claim 1, where the printed design layer has a thickness of less than 0.5 micron.

22. A retroreflective printed material comprising a viewable surface, and further comprising:

a) a microspheres layer completely covering the viewable surface;

b) a priming layer completely covering the microsphere layer;

c) a printed design layer on the priming layer;

d) a binder layer completely covering the priming layer;

e) a base fabric completely covering the binder layer; and f) a reflecting layer completely covering the microsphere layer;

where the reflecting layer is either between the microsphere layer and the priming layer, or is between the printed design layer and the binder layer.

23. The retroreflective printed material of claim 22, where the microspheres are transparent glass microspheres.

24. The retroreflective printed material of claim 22, where the reflecting layer is a dielectric mirror layer.

25. The retroreflective printed material of claim 22, where the reflecting layer is a vapor coating of a metal or thin reflective aluminium film layer.

26. The retroreflective printed material of claim 22, where the priming layer is selected from the group consisting of a thin layer of transparent thermo-adhesive bicomponent polyurethane resin and a resin of a water polyether polyurethane dispersion.

27. The retroreflective printed material of claim 22, where the printed design layer comprises a plurality of colors.

28. The retroreflective printed material of claim 22, where the binder layer is selected from the group consisting of a bicomponent polyurethane resin and a thin layer of a hot-melt adhesive.

29. The retroreflective printed material of claim 22, where the printed design layer has a thickness of less than 0.1 micron.

30. The retroreflective printed material of claim 22, where the printed design layer has a thickness of less than 0.5 micron.

* * * * *